US005277521A

United States Patent [19]

Petkovic et al.

[11] Patent Number: 5,277,521

[45] Date of Patent: Jan. 11, 1994

[54] SEMI-SUBMERSIBLE PRODUCTION PLATFORM

[75] Inventors: Marco A. L. Petkovic; Joper C. Andrade Filho; Marcio F. Alencar, all of Rio de Janeiro, Brazil

[73] Assignee: Petroleo Brasileiro S.A. - PETROBRAS, Rio de Janeiro, Brazil

[21] Appl. No.: 773,269

[22] Filed: Oct. 9, 1991

[30] Foreign Application Priority Data

Oct. 9, 1990 [BR] Brazil ..... PI 9005039

[51] Int. Cl.[5] ..... E02B 17/00

[52] U.S. Cl. ..... 405/223.1; 405/203; 405/224; 405/224.2

[58] Field of Search ..... 114/264-267; 405/195.1, 203, 223.1, 224, 224.2, 224.1

[56] References Cited

U.S. PATENT DOCUMENTS

| | | | |
|---|---|---|---|
| 4,117,690 | 10/1978 | Besse | 405/227 |
| 4,169,424 | 10/1979 | Newby et al. | 405/224 X |
| 4,320,993 | 3/1982 | Hunter | 405/224 |
| 4,470,724 | 9/1984 | Pollack | 405/223.1 X |
| 4,784,529 | 11/1988 | Hunter | 405/227 |
| 4,793,738 | 12/1988 | White et al. | 405/223.1 |
| 4,850,744 | 7/1989 | Petty et al. | 405/224 |
| 4,938,630 | 7/1990 | Karsan et al. | 405/223.1 X |
| 5,012,756 | 5/1991 | Kristensen | 114/265 |
| 5,054,963 | 10/1991 | Williamsson | 405/224 |
| 5,150,987 | 9/1992 | White et al. | 405/224 |

*Primary Examiner*—Randolph A. Reese
*Assistant Examiner*—John Ricci
*Attorney, Agent, or Firm*—Sughrue, Mion, Zinn, Macpeak & Seas

[57] ABSTRACT

A semi-submersible production platform (10) intended for oil production, water injection and oil and gas export includes a hull (11) of basic rectilinear shape consisting of floats (17) with rectangular cross-section forming a closed square ring (12). Four columns (13) of square section are located, one in each vertex, of the closed square ring (12). A risers receipt system (14) consists of lateral supports (15) and connectors of square section (16). A passive anchoring system (19) is provided along with a truss-shaped deck structure (23), an equipment arrangement (24) with full seggregation of process equipment, utilities and quarters. A water intake (25) system at large depths has an intake pipe (26) connected at the top to the float (17) through a flexible coupling (27).

3 Claims, 5 Drawing Sheets

FIG. 2
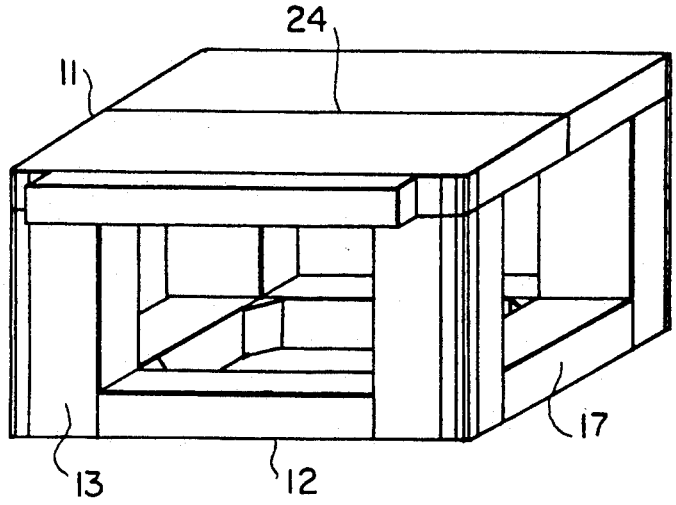
FIG. 3
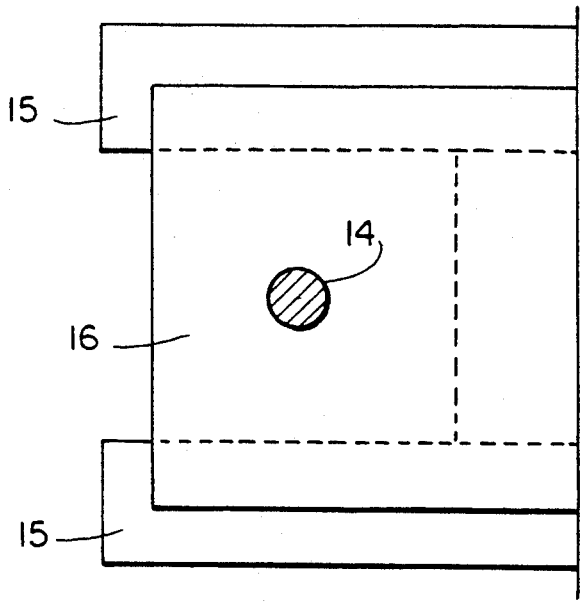
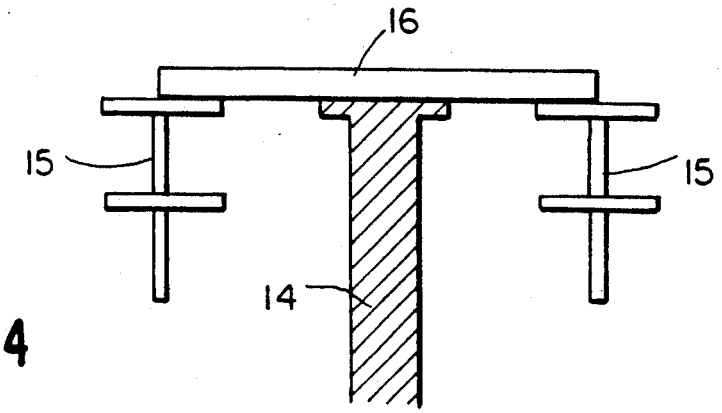
FIG. 4

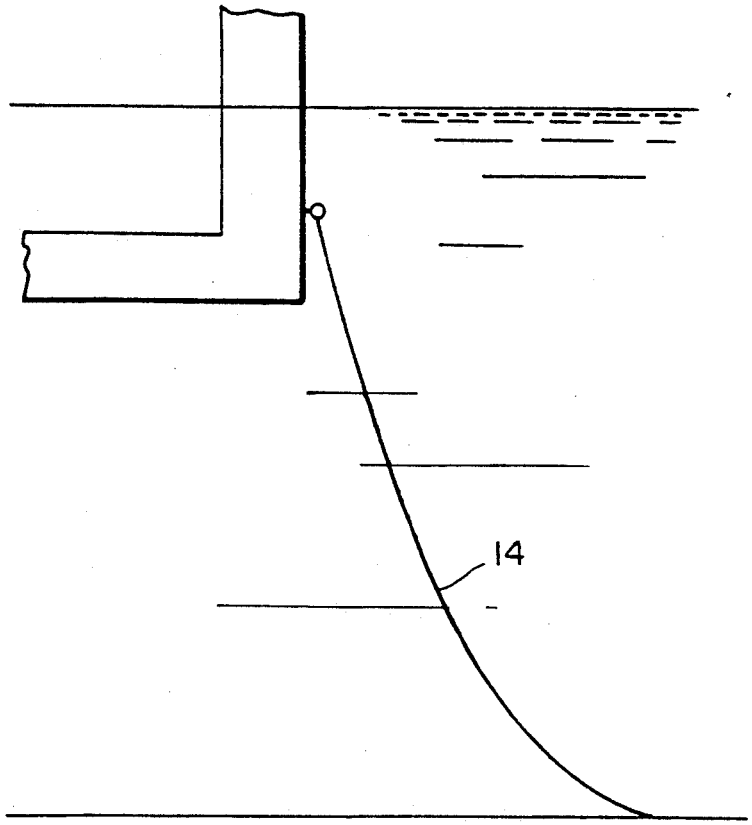
FIG. 8
FIG. 9
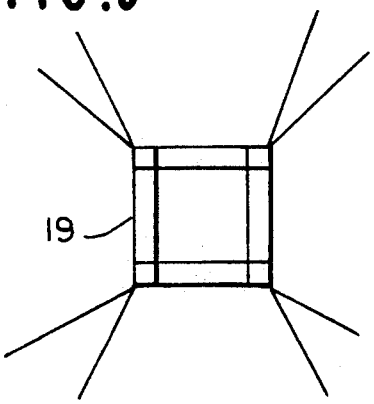
FIG. 10
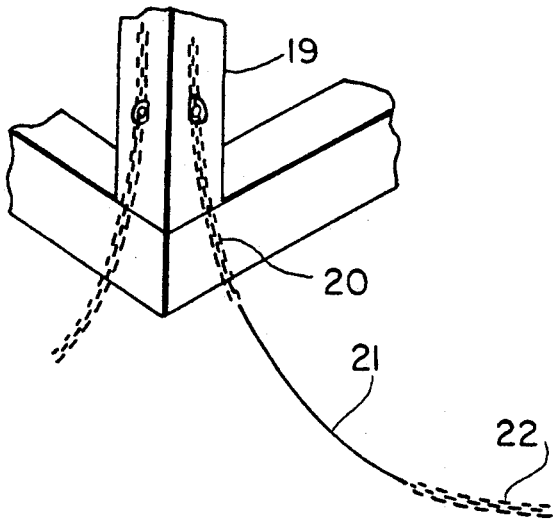

FIG. 11
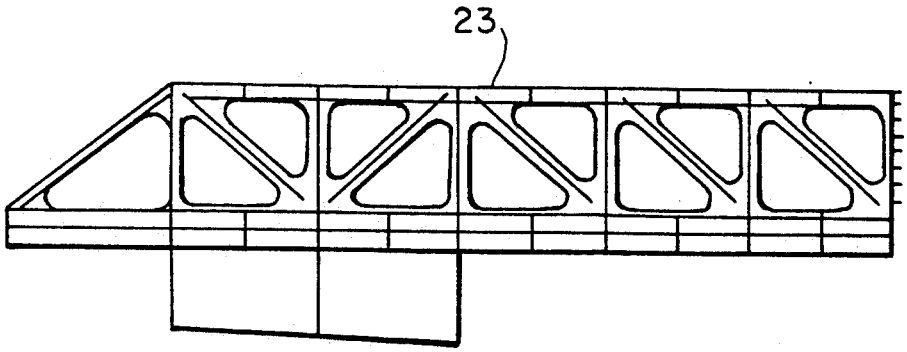
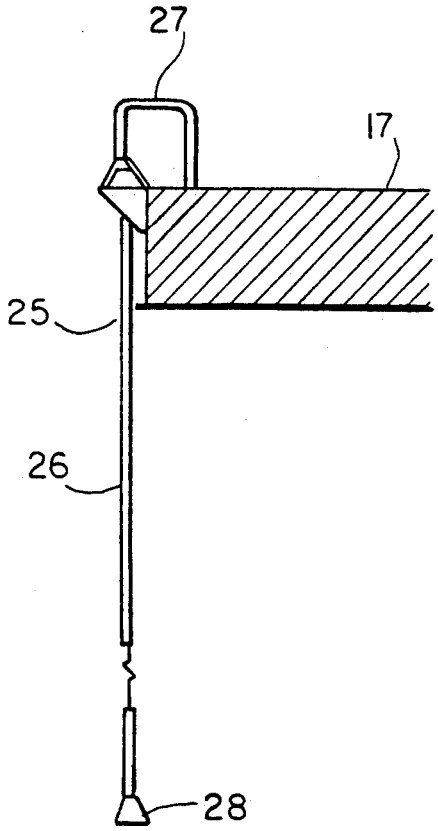
FIG. 12

SEMI-SUBMERSIBLE PRODUCTION PLATFORM

FIELD OF THE INVENTION

This invention refers to a semi-submersible platform for oil production, water injection and oil and gas export.

STATE OF THE ART

The semi-submersible production platforms include various systems, such as water intake, fire fighting, ventilation, air conditioning, power generation, anchoring, risers, etc. . . . The platforms of this type, as known so far, integrate some of these systems, but fail to do so in relation to others of equal importance.

PURPOSES OF THE INVENTION

The purpose of this invention is a semi-submersible production platform which integrates all the systems required for her operation.

More specifically, the purpose of this invention is a semi-submersible production platform which lodges better the process equipment, allowing also for the natural ventilation of said equipment, as well as integrates all production facilities, the naval utilities, the plant utilities, the platform architecture and the hull structure.

It is also the object of this invention a semi-submersible platform which utilized a model of closed-ring floats, making the floats responsible for the structural stiffness, with a deck relieved and less rigid.

DESCRIPTION OF THE INVENTION

The semi-submersible production platform, object of this invention, includes:

a—a hull of rectilinear shape, formed by standardized parts, which makes easy to assemble is in medium- and small-size shipyards;

b—a risers receipt system where the supporting of the risers connectors is achieved at float level, which minimizes the dynamic loads applied to the platform and the problems of interference with the structure, thus eliminating the requirement of deck space to support the connectors, and also increasing the operational safety, since an area of risk is moved away from the crew;

c—a passive anchoring system which eliminates the traditional windlasses, which makes it possible to reduce the weight on the deck, increase the space availability, utilize gravity piles and thus reduce the anchoring radius and clear the marine ground;

d—a truss-shaped deck structure which allows for the natural ventilation of the process areas and of the large thermal dissipation equipment;

e—a system of water intake at large depths which eliminates the need for the usual systems of water cooling;

f—a fire-fighting system integrated with the utilities of intake, injection, cooling and ballast water;

g—an equipment arrangement with full seggregation of the process equipment, utilities and quarters, thus increasing the operational safety of the platform.

BRIEF DESCRIPTION OF THE DRAWINGS

The invention shall be hereafter described in more detail together with the drawings which integrate this specification, in which:

FIG. 2 is a perspective view of the basic shape of the platform hull;

FIGS. 3, 4 and 5 are top plan, front and lateral views, respectively, of the connector of a risers receipt system;

FIG. 8 is an illustrative view showing the catenary formed by each riser;

FIG. 9 is a top plan view of the anchoring system;

FIG. 10 is a perspective plan of the anchoring system;

FIG. 11 is a front view of the deck structure; and

FIG. 12 is a front view of the water-intake system.

DETAILED DESCRIPTION OF THE INVENTION

Figure 1:
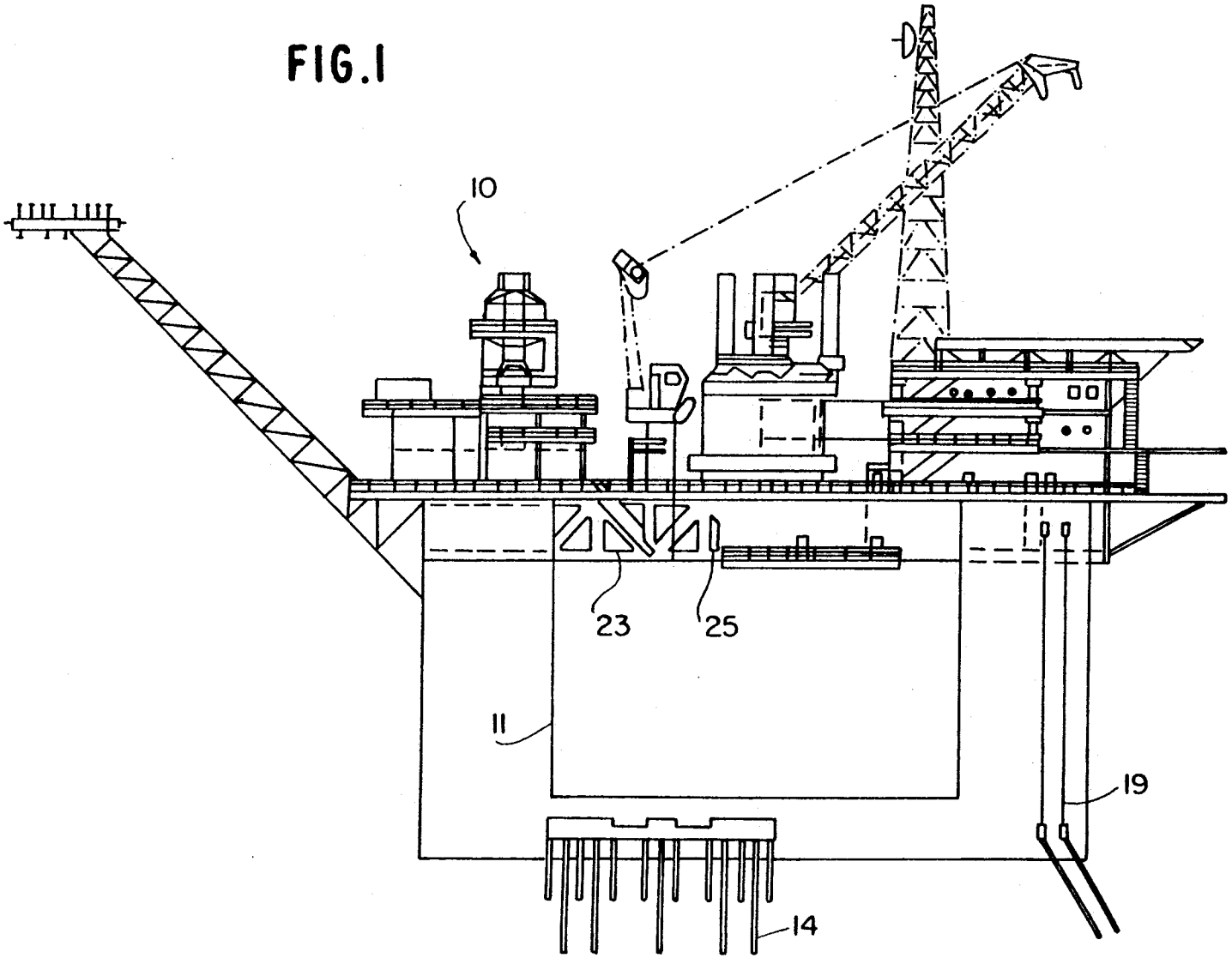
FIG. 1 is a front view of a semi-submersible production platform, forming a preferred embodiment of this invention.
Figure 5:
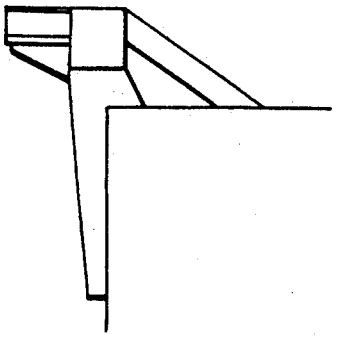
Figure 6:
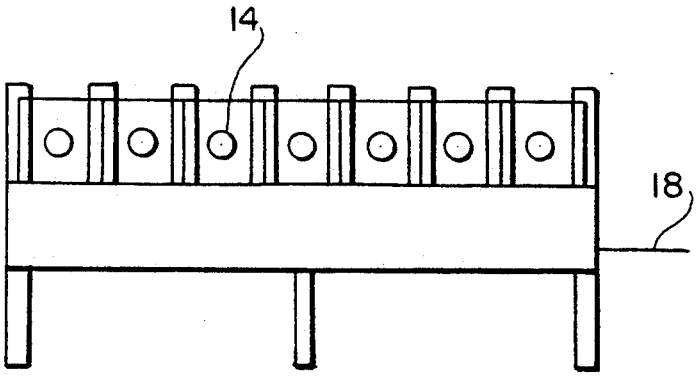
FIG. 6 is a top plan view of a set of risers positioned on the pontoon.
Figure 7:
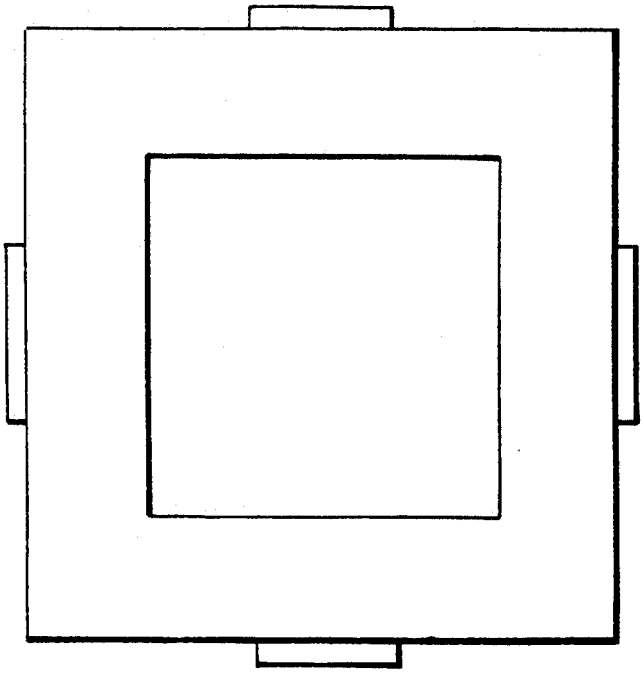
FIG. 7 is a top plan view of the arrangement of the risers receipt system at the platform.

As it can be inferred from the Figures, the semi-submersible production platform, referred to in general by number 10 on FIG. 1, intended for oil production, water injection and oil and gas export in water depths in excess of 400 m, includes a hull 11 of basic rectilinear and standardized shape, so as to permit assembly in medium- and small-size shipyards. The platform consists of a float of rectangular cross-section forming a closed square ring 12, FIG. 2, and four columns 13 of square section, located one in each vertex of the closed square ring 12, this configuration withstands the stresses induced by the waves at the level of the float, and which being a closed ring, presents higher stiffness than a configuration with two pontoons, thus making possible to eliminate bracings and rendering the structure more compact and easier to build. A risers receipt system 14, FIG. 1, provides a lateral support 15 of connectors 16 of square section to be achieved at the level of the float 17. The result is minimizing the dynamic loads applied to the platform 10 and the problems of interference with the structure, while eliminating the need for deck space to support the connectors and increasing the operational safety, and moving away from the crew an area of risk. As shown also in FIG. 6, a set of seven risers are positioned on the pontoon 18. FIG. 8 illustrates the catenary formed by each riser 14. A passive anchoring system 19 where the arrangement of the anchoring lines and the composition may be seen in FIGS. 9 and 10. A pre-laid anchoring consisting of chain 20, line or cable 21, and chain 22 reduces the anchoring loads on the platform 10. A truss-shaped deck structure 23, FIG. 11, allows for the natural ventilation of the process areas and of the large thermal dissipation equipment. An equipment arrangement 24 with full seggregation of the process equipment, utilities and quarters, increases the operational safety of the platform. A water-intake system 25 at large depths, FIG. 12, has an intake pipe 26 connected to the float 17 through a flexible coupling 27 and receives cold water through a bell mouth 28 at the platform, eliminating systems of water cooling; and a fire-fighting system integrated with the units of water intake, injection, cooling and ballast.

It must be pointed out that the rectilinear shape and the configuration of the hull 11 maximize the utilization of fillet welding, which can be automatically done with high efficiency and small similar blocks optimize the prefabrication of the structure in workshops, reducing thus the costs. The small dimensions of the hull make it possible for a larger number of shipyards to have technical conditions to build the unit. The shape of the hull also allows the hull and the deck to be built in different sites, with both parts being connected through a mating operation which, due to the reduced dimensions, could be achieved in a region with nearly only 28 m. The shape of the hull allows it to be built with alternative materials, such as concrete, for instance.

The main characteristic of the platform 10 is, therefore, the integration among the various systems, resulting from such integration the open deck, allowing for the natural ventilation of the equipment, intake of cold water at large depths, risers sustained by the floats, passive anchoring, etc.

We claim:

1. A semi-submersible production platform, intended for oil production, water injection and oil and gas delivery, comprising:

a hull of basically rectilinear shape consisting of a float of rectangular cross-section forming a closed square ring and four columns of square cross-section located on each of four vertices of said closed square ring; a risers receipt system consisting of lateral connectors and square cross-section connectors, a passive anchoring system, a truss-shaped deck structure, an equipment support with full segregation of process equipment, utilities and accommodation, and a water intake system effective at large depths including an intake pipe connected at a top thereof to the float by means of a flexible coupling, said intake pipe being further provided, at a lower end thereof, with a bell mouth.

2. A semi-submersible production platform according to claim 1, wherein in said risers receipt system, a lateral support for said connectors is effected at the level of the float.

3. A semi-submersible production platform according to claim 1 or 2, wherein said passive anchoring system includes a pre-laid anchoring consisting of multiple lines connected beteen two chains and tethered respectively to said float at said four columns by one end of one chain of each line.

* * * * *